US009583883B2

(12) United States Patent
Bourgue et al.

(10) Patent No.: US 9,583,883 B2
(45) Date of Patent: Feb. 28, 2017

(54) METHOD FOR RE-ESTABLISHING THE SHIELDING OF THE CABLES OF A STRAND ON AN ELECTRICAL CONNECTOR AND ASSEMBLY FOR CONNECTING A STRAND

(71) Applicant: THALES, Neuilly-sur-Seine (FR)

(72) Inventors: Olivier Bourgue, Draguignan (FR); Guillaume Prevost, La Roquette sur Siagne (FR); Anthony Pajot, Cannes (FR)

(73) Assignee: THALES, Courbevoie (FR)

( * ) Notice: Subject to any disclaimer, the term of this patent is extended or adjusted under 35 U.S.C. 154(b) by 188 days.

(21) Appl. No.: 14/211,942

(22) Filed: Mar. 14, 2014

(65) Prior Publication Data

US 2014/0273630 A1 Sep. 18, 2014

(30) Foreign Application Priority Data

Mar. 15, 2013 (FR) ..... 13 00580

(51) Int. Cl.

| | |
|---|---|
| ***H01B 7/18*** | (2006.01) |
| ***H01R 9/03*** | (2006.01) |
| ***H01R 43/00*** | (2006.01) |
| ***H01R 13/648*** | (2006.01) |
| ***H01R 13/6592*** | (2011.01) |

(52) U.S. Cl.

CPC ..... *H01R 13/648* (2013.01); *H01R 9/032* (2013.01); *H01R 13/6592* (2013.01); *H01R 43/00* (2013.01); *H01R 43/002* (2013.01); *Y10T 29/49174* (2015.01)

(58) Field of Classification Search

CPC .. H01R 13/648; H01R 13/6592; H01R 9/032; Y10T 29/49174

USPC ..... 174/104; 439/607.41; 29/857

See application file for complete search history.

(56) References Cited

U.S. PATENT DOCUMENTS 4,731,500 A * 3/1988 Otsuka ..... H01B 5/14 174/115
5,358,426 A * 10/1994 Henschen ..... B23K 3/0475 439/497
5,504,274 A * 4/1996 McCabe ..... H01B 11/1033 156/50

(Continued)

FOREIGN PATENT DOCUMENTS

DE 19936508 A1 3/2001
FR 2917542 A1 12/2008

(Continued)

*Primary Examiner* — Timothy Thompson
*Assistant Examiner* — Rhadames J Alonzo Miller
(74) *Attorney, Agent, or Firm* — Baker & Hostetler LLP

(57) ABSTRACT

The method for re-establishing the shielding of the cables of a strand on an electrical connector consists, over an annular part situated at one end connected to the connector, in removing only the outer insulating sheath of each shielded cable without stripping the cables of their electromagnetic shield, in grouping the shielded cables together into a strand and in surrounding the strand with an electrically conducting tape forming a sheath re-establishing the shielding of the strand, the sheath re-establishing the shielding being positioned in contact with the electromagnetic shield of the shielded cables and connected to the connector.

7 Claims, 4 Drawing Sheets

(56) References Cited

U.S. PATENT DOCUMENTS 6,107,572 A * 8/2000 Miyazaki ..... H01R 9/0518 174/75 C
6,528,728 B1 * 3/2003 Shima ..... H02G 3/0437 174/101
2002/0155738 A1 * 10/2002 Ohsawa ..... B60Q 1/0088 439/98
2002/0157843 A1 * 10/2002 Fukushima ..... H01R 9/032 174/353
2003/0062177 A1 * 4/2003 Yagi ..... H01R 9/032 174/359
2005/0193556 A1 * 9/2005 Ikeda ..... H01R 9/032 29/868
2005/0266729 A1 * 12/2005 Fukushima ..... H01R 9/032 439/607.46
2006/0090921 A1 * 5/2006 Sato ..... H01R 9/032 174/75 C
2007/0095552 A1 * 5/2007 Thierolf ..... H01B 7/0861 174/36
2007/0275199 A1 * 11/2007 Chen ..... D02G 3/441 428/36.1
2008/0318462 A1 * 12/2008 Gerard ..... H01R 13/6272 439/353
2009/0004896 A1 * 1/2009 Gerard ..... H01R 13/6599 439/95
2009/0093159 A1 * 4/2009 Aoki ..... H01R 9/032 439/607.41
2009/0126985 A1 * 5/2009 Aoki ..... H02G 3/0683 174/377
2009/0126993 A1 * 5/2009 Nishimura ..... H01B 3/28 174/72 A
2009/0130903 A1 * 5/2009 Tsukashima ..... H01R 9/032 439/607.23
2009/0294149 A1 * 12/2009 Watanabe ..... H01B 7/16 174/102 R
2009/0314511 A1 * 12/2009 Hagi ..... H01R 4/726 174/78
2011/0146072 A1 * 6/2011 Biesse ..... H01R 9/032 29/887
2014/0038459 A1 * 2/2014 Kobayashi ..... H01R 9/032 439/607.41

FOREIGN PATENT DOCUMENTS

FR 2929049 A1 9/2009
NL EP 0687037 A1 * 12/1995 ..... H01R 9/038

* cited by examiner

METHOD FOR RE-ESTABLISHING THE SHIELDING OF THE CABLES OF A STRAND ON AN ELECTRICAL CONNECTOR AND ASSEMBLY FOR CONNECTING A STRAND

CROSS-REFERENCE TO RELATED APPLICATION

This application claims priority to foreign French patent application No. FR 1300580, filed on Mar. 15, 2013, the disclosure of which is incorporated by reference in its entirety.

FIELD OF THE INVENTION

The present invention relates to a method for re-establishing the shielding of the cables of a strand on an electrical connector and to an assembly for connecting a strand. It applies to the wiring of any shielded electrical cable and more particularly to the connecting cables used in the space or aerospace domains.

BACKGROUND

One conventional method for re-establishing the shielding of an electric cable on a connector is to attach a shield re-establishing comb to the body of the connector and to solder, by hand, a first end of a shielding re-establishing wire to a tooth of the comb and a second end of the shielding re-establishing wire to the shielding of the cable. This method has the disadvantage of being complicated to perform because on the one hand it requires the external gold-plating layer of the connector to have been removed, and this presents a risk of damaging the insulating block of the connector and of leading to wiring anomalies, and on the other hand, manual soldering is a tricky operation and requires expert inspection. Moreover, this method does not allow the wiring to be repaired or modified and creates electromagnetic coupling between the wire re-establishing the shielding and the electrical wire of the cable carrying the signal. Finally, for a strand comprising a great many cables, this method needs to be repeated for each individual cable of the strand, representing a very long wiring time for each strand.

Another known method for re-establishing shielding is described notably in document FR 2 929 049. In this method, the ends of the cables are stripped. The individual shielding sheath of each cable of a strand is removed from an end portion of the cable and each exposed shielding filament of the cable is folded back away from the connector. The connection between the shield of a cable and the shield of the strand is performed using the exposed and folded back filaments of shield which need to be distributed uniformly around the circumference of the strand and held in place by successive windings of a filler tape. However, exposing the shield of each individual cable and connecting the shield of a cable and the shield of the strand are complex manual operations which are lengthy and tricky to perform and greatly degrade and weaken the stripped portion and cannot be industrialized.

SUMMARY OF THE INVENTION

It is an object of the invention to overcome the disadvantages of the known methods for re-establishing shielding and to produce a method for re-establishing the shielding of the cables of a strand on an electrical connector which is simple and can be industrialized, which does not require the cable shield to be removed, which does not involve operations that are tricky to perform and does not require expert inspection and which allows a very appreciable reduction in the time taken to re-establish the shielding of the strand.

To achieve that, the invention relates to a method for re-establishing the shielding of the cables of a strand on an electrical connector, the strand comprising shielded cables, each shielded cable being made up of an internal conductor, of a first primary insulating sheath surrounding the conductor, of an electromagnetic shield surrounding the primary insulating sheath and of an outer insulating sheath surrounding the electromagnetic shield, each cable of the strand comprising one end connected to the electrical connector. The method consists, over an annular part situated at the end connected to the connector, in removing only the outer insulating sheath of each shielded cable without stripping the cables of their electromagnetic shield, then in grouping all the shielded cables together into a strand and in surrounding the strand with an electrically conducting tape positioned in contact with the electromagnetic shield of the shielded cables, and in connecting the electrically conducting tape to the connector When the strand comprises shielded cables and non-shielded cables, each non-shielded cable being made up of an internal conductor and of an insulating sheath surrounding the conductor, the method further consists in grouping together the non-shielded cables in one or more groups of non-shielded cables, in surrounding each group of non-shielded cables with an electrically conducting tape forming a local external shielding sheath around each group of non-shielded cables, then in grouping together all the shielded cables and all the groups of non-shielded cables equipped with their local shielding sheath to form the strand, the external electrically conducting tape surrounding the strand being positioned in contact with the electromagnetic shielding of the shielded cables and with the local external shielding sheath of each group of non-shielded cables and forming a sheath that re-establishes the electromagnetic shielding of all the cables of the strand.

When the strand further comprises earthing wires, the method further consists in positioning the earthing wires on the outside of the external electrically conducting tape of the strand formed by all the groups of cables, then in surrounding the entirety of the strand and of the earthing wires with one or more additional turns of external electrically conducting tape, in folding the ends of the earthing wires back onto the external electrically conducting tape then in surrounding the entirety of the strand and of the folded-back earthing wires with one or more additional turns of external electrically conducting tape.

Advantageously, the method further consists either in holding and clamping the external electrically conducting tape arranged around the strand in a metal cable clamp in contact with the external electrically conducting tape and with the connector, or alternatively, in installing and closing a metal cap of the connector and in covering the external electrically conducting tape with an annular overbraid having one end connected to the cap of the connector.

Advantageously, the overbraid may be attached using cable ties.

The invention also relates to an assembly for connecting a strand obtained using the method for re-establishing shielding, the strand comprising shielded cables having one end connected to a connector, the shielded cables being provided with an electromagnetic shield visible at an annular part situated at the end connected to the connector, the shielded cables being grouped together into a strand, the strand being surrounded by an electrically conducting tape positioned in contact with the visible electromagnetic shield of the shielded cables, the electrically conducting tape being connected to the connector.

Advantageously, the strand of the connection assembly comprises shielded cables and non-shielded cables, the non-shielded cables being grouped together into one or more groups of non-shielded cables, each group of non-shielded cables being surrounded by an electrically conducting tape forming a local shielding sheath, and all the groups of shielded and non-shielded cables are grouped together into a strand, the strand being surrounded with at least one turn of external electrically conducting tape positioned in contact with the visible electromagnetic shield of the shielded cables and with the local external shielding sheath of each group of non-shielded cables.

Advantageously, the connection assembly further comprises a metal cable clamp in contact with the external electrically conducting tape of the strand and with the connector.

Advantageously, the cable clamp comprises two clamping plates separated by spacers and fixed together.

Alternatively, the connector comprises a metal cap and the external electrically conducting tape is covered with an annular overbraid having one end connected to the cap of the connector

BRIEF DESCRIPTION OF THE DRAWINGS

Other specifics and advantages of the invention will become clearly apparent from the continuation of the description given purely by way of nonlimiting illustrative example, with reference to the attached schematic drawings which depict.

DETAILED DESCRIPTION

Figure 1:
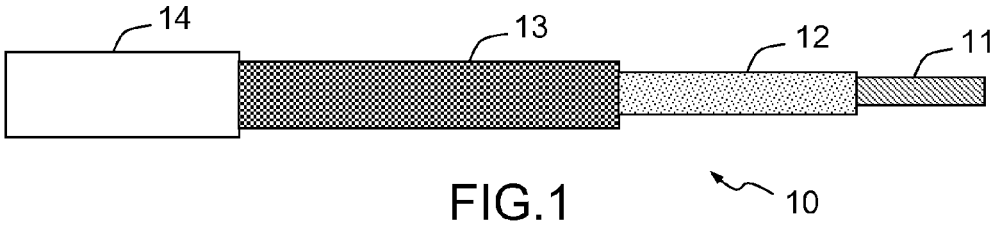
FIG. 1: an example showing the structure of a shielded cable, according to the invention.
Figure 2:
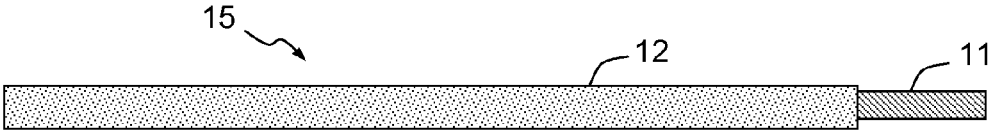
FIG. 2: an example showing the structure of a non-shielded cable, according to the invention.

As depicted in FIG. 1, a shielded cable 10 is made up of an internal conductor 11, a first primary insulating sheath 12 surrounding the conductor, an electromagnetic shield 13 surrounding the primary insulating sheath and an outer insulating sheath 14 surrounding the electromagnetic shield. As depicted in FIG. 2, a non-shielded cable 15 is made up of an internal conductor 11 and of an insulating sheath 12 surrounding the conductor. A strand comprises several cables which may be shielded 10 and/or non-shielded 15 as depicted for example in the embodiment specifically described and depicted in FIGS. 3 to 8.

Figure 3A:
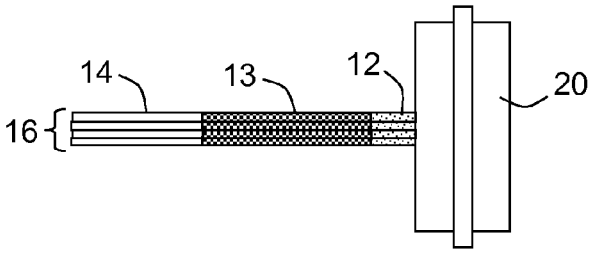
FIG. 3*a*: a diagram illustrating a connection assembly comprising a group of several shielded cables connected to a connector, according to the invention.
Figure 3B:
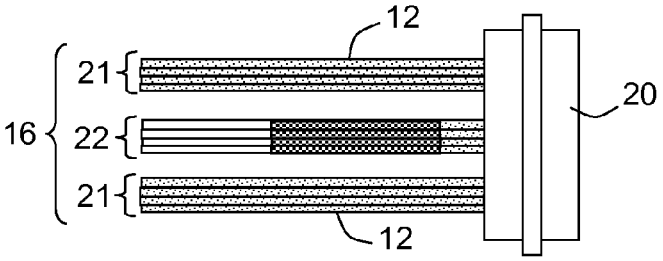
FIG. 3*b*: a diagram illustrating a connection assembly comprising a group of several shielded cables and two groups of several non-shielded cables, all the cables being connected to the one same connector, according to the invention.
Figure 5A:
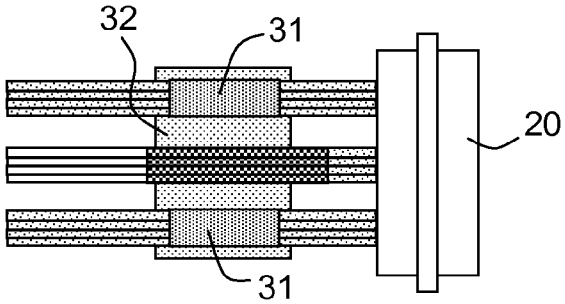
FIG. 5*a*: a diagram illustrating a second step in the method when the strand comprises shielded cables and non-shielded cables, according to the invention.

In FIG. 3*a*, the strand 16 comprises only shielded cables. In FIG. 3*b*, the strand 16 comprises shielded cables 10 and non-shielded cables 15, each cable 10, 15 of the strand 16 having one end connected to the one same electrical connector 20. According to the invention, only the outer insulating sheath 14 of each shielded cable 10 is removed over an annular part situated at the end connected to the connector 20. The cables are not stripped of their electromagnetic shield which therefore remains intact and thus constitutes an external layer of the cable over the annular end part. At the end of each cable, over the annular part, the electromagnetic shield 13 remaining in place on the cable is therefore visible. The shielded cables 10 are therefore grouped together into at least one first group of cables. When the shielded cables 10 are distant from one another it is possible to group them together into two or three different groups 22 depending on how they are laid out on the connector 20. When the strand comprises only shielded cables, the method then consists in grouping together all of the shielded cables to form the strand 16 and, as depicted in FIG. 5*a*, in surrounding the strand with a sheath for re-establishing shielding 32, which sheath is made up of at least one turn of an electrically conducting tape, the sheath for re-establishing shielding 32 being positioned in contact with the electromagnetic shield 13 visible on the annular part situated at the end of the shielded cables. The sheath for re-establishing shielding 32 thus re-establishes the electromagnetic shielding of all the cables of the strand 16.

The electrically conducting tape that constitutes the sheath that re-establishes shielding 32 may be a strip or a mesh or a braid. The material of the sheath that re-establishes shielding 32 may be metallic or a non-metallic material filled with electrically conducting particles. The electrically conducting tape may potentially contain an adhesive on one of its faces, the adhesive being filled with electrically conducting particles. If necessary, the electrically conducting tape can be held in place using a cable tie.

Figure 4A:
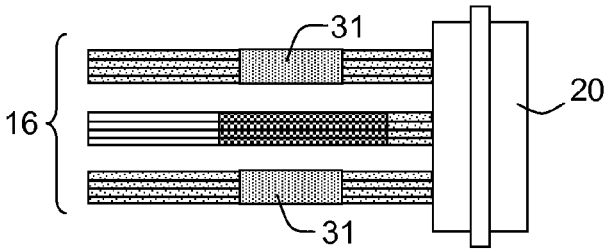
FIG. 4*a*: a diagram illustrating a first step in the method for re-establishing shielding when the strand comprises shielded cables and non-shielded cables, according to the invention.
Figure 4B:
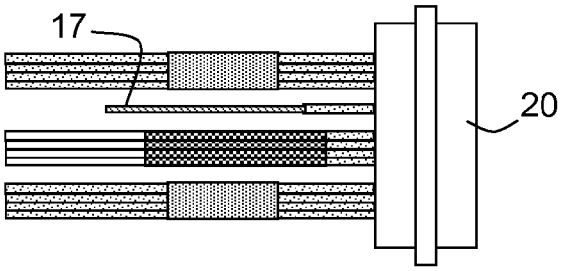
FIG. 4*b*: a diagram illustrating a first step in the method of re-establishing shielding when the strand comprises shielded cables, non-shielded cables, and at least one earthing wire, according to the invention.

When the strand 16 comprises non-shielded cables 15, the invention further consists in grouping together the non-shielded cables 15 into one or more groups 21 of non-shielded cables depending on how they are laid out on the connector 20, for example in FIG. 3*b*, the non-shielded cables are grouped together into two different groups 21 then, as depicted in FIG. 4*a*, in surrounding each group 21 of non-shielded cables with an electrically conducting tape so as to form a local external shielding sheath 31 around each group of non-shielded cables. The local external shielding sheath 31 is positioned in contact with the insulating sheath 12 of the non-shielded cables 15. Just one turn of electrically conducting tape 31 around each group of non-shielded cables 10 will generally suffice, but it is possible to add one or more additional turns.

Figure 5B:
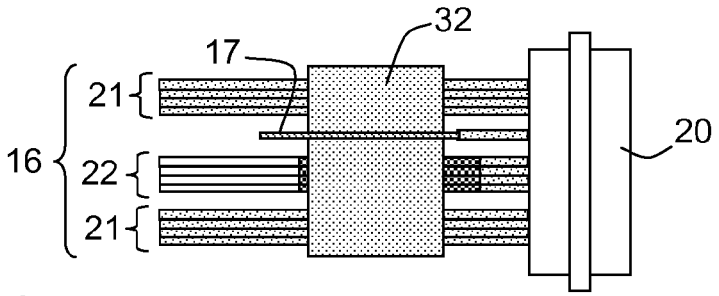
FIGS. 5*b* to 5*e*: four diagrams illustrating a second step in the method when the strand comprises shielded cables, non-shielded cables and at least one earthing wire, according to the invention.
Figure 5C:
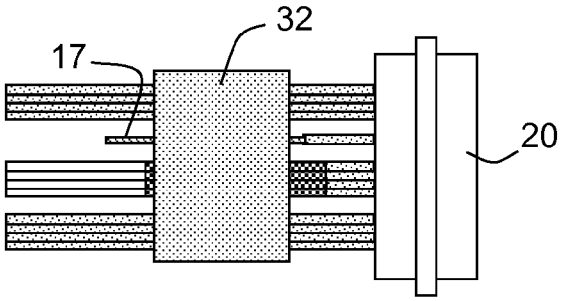
Figure 5D:
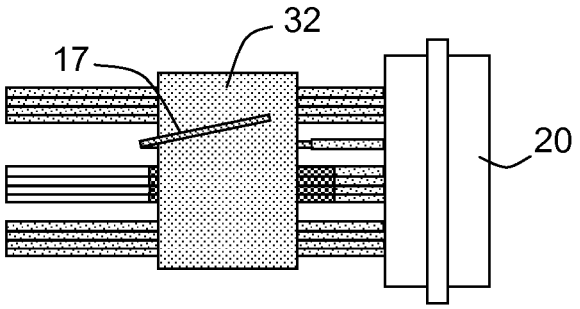
Figure 5E:
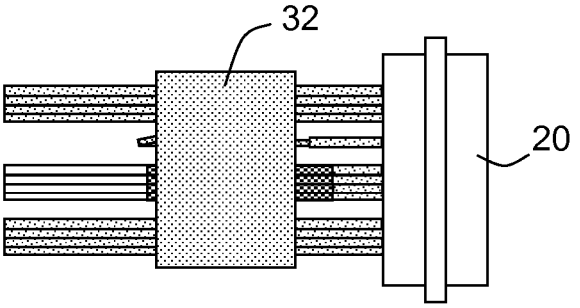
Figure 6A:
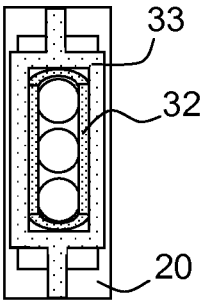
FIGS. 6*a* and 6*b*: a diagram in cross section and a longitudinal schematic view illustrating a third step of the method, according to the invention.
Figure 6B:
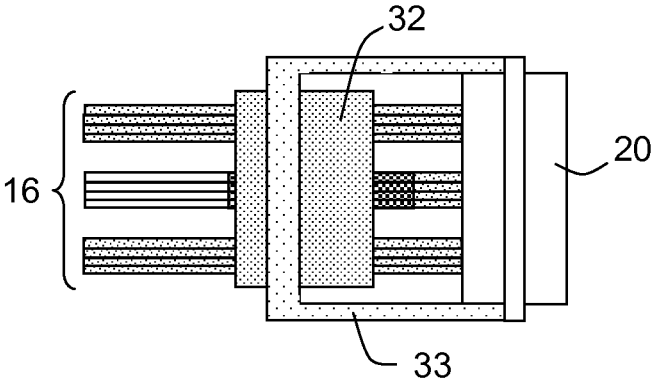
Figure 7:
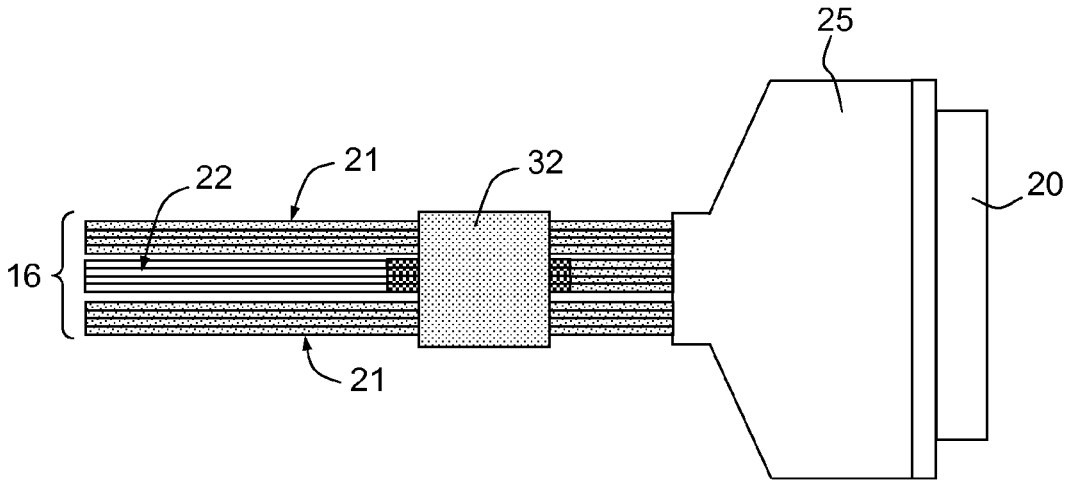
FIGS. 7 and 8: two diagrams respectively illustrating a fourth and a fifth step in the method, according to the invention.

The method then consists in grouping together the various groups of cables to form a strand 16 and in surrounding the strand 16 with at least one turn of external electrically conducting tape in order to produce the sheath that re-establishes shielding 32, as depicted in FIG. 5*a*. If some of the shielded cables 10 comprise earthing wires, as depicted for example in FIG. 4*b*, then the method further consists in leaving the earthing wires outside the strand 16 thus formed and as depicted in FIG. 5*b*, in positioning them on the sheath that re-establishes the shielding 32 of the strand 16. The method next consists, as depicted in FIG. 5*c*, in surrounding the entirety of the strand and earthing wires with one or more additional turns of external electrically conducting tape and then, as depicted in FIG. 5*d*, in folding the end of the earthing wires back onto the external electrically conducting tape then, as depicted in FIG. 5*e*, in surrounding the entirety of the strand 16 and of the folded-back earthing wires with one or more additional turns of external electrically conducting tape. The external electrically conducting tape that forms the sheath that re-establishes the shielding 32 of the strand 16 can be held in place with a cable tie if necessary.

The various groups of cables of the strand 16 may therefore be connected to the housing of the connector 20 via the sheath that re-establishes the shielding 32 of the strand 16. The sheath that re-establishes shielding 32 may be connected to the housing of the connector 20 directly or indirectly in order to re-establish the electromagnetic shielding of the strand 16 on the connector 20. The connection between the sheath that re-establishes shielding 32 and the housing of the connector 20 may be achieved using a cable clamp 33 or using an electrically conducting closed cap 25.

In instances in which the connector 20 has no closed metallic cap, the electrically conducting tape of the sheath that re-establishes shielding 32 arranged around the strand 16 can be held in place using a cable tie, not depicted. The cable tie is positioned on an annular edge of the electrically conducting tape which edge is situated at the opposite end from the connector 20. The strand 16 can be clamped in a metal cable clamp 33 in contact with the electrically conducting tape 32 of the strand 16 and with the connector 20 as depicted in the cross-sectional view of FIG. 6*a* and the longitudinal view of FIG. 6*b*. The cable clamp 33 may for example comprise two clamping plates fixed together and separated by spacers. It is possible to add one or more additional turns of electrically conducting tape 32 around the strand 16 in order, for example, to form a filling and ensure good contact between the electrically conducting tape 32 and the cable clamp 33.

Figure 8:
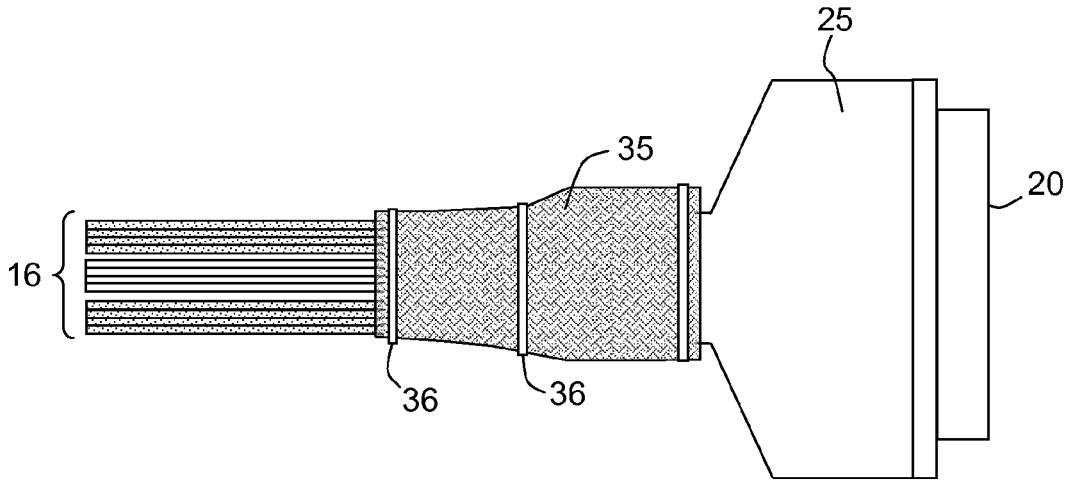

Alternatively, in instances in which the connector 20 comprises a closed metal cap 25, there is no need to use a cable clamp and the invention therefore consists in covering the electrically conducting tape that forms the sheath that re-establishes the shielding 32 of the strand 16 with an annular overbraid 35, as depicted in FIG. 8. The overbraid 35 has a first end connected to the cap 25 of the connector 20 and a second end fixed to the strand. The overbraid 35 needs to be held in position around the strand 16 and around the cap, for example using cable ties 36 positioned at its two ends and possibly in an intermediate zone situated between its two ends. The electrically conducting tape 32, which is not visible in FIG. 8, and the overbraid 35 therefore constitute a re-establishing of the electromagnetic shielding 16 on the cap 25 of the connector 20.

Thus, over its entire circumference, the shield of each cable is in contact only with other cable shields and/or with electrically conducting tapes. The shielding of a cable is therefore re-established over its entire circumference using conducting elements such as the electrically conducting tapes 31, 32 and the cable clamp 33 which earth the shields of all the cables 10, 15 of the strand 16. The result of this is that with the method of the invention, the earthing of the shield of each cable is optimum.

Although the invention has been described in conjunction with specific embodiments, it is quite obvious that it is not in any way restricted thereto and that it encompasses all technical equivalents of the means described and combinations thereof where these fall within the scope of the invention.

The invention claimed is:

1. A method for re-establishing shielding of cables of a strand on an electrical connector, the strand comprising shielded cables, each shielded cable being made up of an internal conductor, of a first primary insulating sheath surrounding the internal conductor, of an electromagnetic shield surrounding the first primary insulating sheath, and of an outer insulating sheath surrounding the electromagnetic shield, each cable of the strand comprising one end connected to the electrical connector, said method consisting, over an annular part situated at the end connected to the connector, in:

removing only the outer insulating sheath of each shielded cable without stripping respective electromagnetic shields;

grouping all the shielded cables together;

surrounding the strand with an external electrically conducting tape positioned in contact with at least one electromagnetic shield of the shielded cables;

holding and clamping the external electrically conducting tape in a metal cable clamp, with the metal cable clamp being in direct physical contact with the external electrically conducting tape and direct physical contact with the connector to connect the external electrically conducting tape to the connector.

2. The method for re-establishing the shielding of the cables of the strand according to claim 1, the strand comprising the shielded cables and non-shielded cables, each non-shielded cable being made up of an internal conductor and of an insulating sheath surrounding the conductor, said method further consisting in prior to the surrounding the strand with the external electrically conducting tape:

grouping together the non-shielded cables in one or more groups of non-shielded cables;

surrounding each group of non-shielded cables with an electrically conducting tape forming a local external shielding sheath around each group of non-shielded cables; and grouping together all the shielded cables and all the groups of non-shielded cables, wherein the external electrically conducting tape is positioned in contact with the electromagnetic shielding of the shielded cables and the local external shielding sheath of each group of non-shielded cables and forms a sheath that re-establishes the shielding of the cables of the strand according to the surrounding the strand with the external electrically conducting tape.

3. The method of re-establishing the shielding of the cables of the strand according to claim 1, the strand further comprising earthing wires, said method further consisting in:

positioning the earthing wires on the outside of the external electrically conducting tape surrounding the strand;

surrounding the entirety of the strand and of the earthing wires with one or more additional turns of the external electrically conducting tape;

folding ends of the earthing wires back onto the external electrically conducting tape; and surrounding the entirety of the strand and the ends of the earthing wires with one or more additional turns of the external electrically conducting tape.

4. An assembly for connecting a strand obtained using the method according to claim 1, wherein the strand comprises shielded cables having one end connected to a connector, the shielded cables being provided with an electromagnetic shield visible at an annular part situated at the end connected to the connector, the shielded cables being grouped together, the strand being surrounded by an external electrically conducting tape positioned in contact with at least one visible electromagnetic shield of the shielded cables, the external electrically conducting tape being connected to the connector.

5. The assembly for connecting the strand according to claim 4, wherein the strand comprises the shielded cables and non-shielded cables, the non-shielded cables being grouped together into one or more groups of non-shielded cables, each group of non-shielded cables being surrounded by an electrically conducting tape forming a local shielding sheath, and in that the shielded cables and the groups of the non-shielded cables are grouped together into the strand, the strand being surrounded with at least one turn of the external electrically conducting tape positioned in contact with the visible electromagnetic shield of the shielded cables and with the local external shielding sheath of each group of non-shielded cables.

6. The assembly for connecting a strand according to claim 5, further comprising a metal cable clamp in direct physical contact with the external electrically conducting tape of the strand and direct physical contact with the connector.

7. The assembly for connecting a strand according to claim 6, wherein the cable clamp comprises two clamping plates separated by spacers and fixed together.

* * * * *